United States Patent [19]

Gokhale

[11] 3,945,907

[45] Mar. 23, 1976

[54] ELECTROLYTIC CELL HAVING RHENIUM COATED CATHODES

[75] Inventor: Sudarshan D. Gokhale, Trenton, Mich.

[73] Assignee: BASF Wyandotte Corporation, Wyandotte, Mich.

[22] Filed: Sept. 16, 1974

[21] Appl. No.: 506,557

[52] U.S. Cl. ..... 204/266; 204/242; 204/252; 204/256; 204/278; 204/290 R; 204/290 F; 204/292

[51] Int. Cl.[2] ..... C25B 11/04; C25B 9/00

[58] Field of Search ..... 204/242, 252, 254, 266, 204/278, 290 R, 290 F, 292, 256; 136/120 FC

[56] References Cited

UNITED STATES PATENTS

| | | | |
|---|---|---|---|
| 1,427,171 | 8/1922 | Smith | 204/242 |
| 3,282,808 | 11/1966 | Kandler | 204/290 R |
| 3,562,008 | 2/1971 | Martinsons | 204/290 F |

*Primary Examiner*—T. Tung
*Assistant Examiner*—W. I. Solomon
*Attorney, Agent, or Firm*—Bernhard R. Swick; Robert E. Dunn; Joseph D. Michaels

[57] ABSTRACT

The use of composite cathodes comprising a metal substrate having thereon a coating of rhenium in electrolytic cells for the electrolysis of aqueous alkali metal halide solutions reduces the cell voltage requirements in comparison to the conventional ferrous metal cathodes traditionally used in such cells.

9 Claims, No Drawings

ELECTROLYTIC CELL HAVING RHENIUM COATED CATHODES

BACKGROUND

1. Field of the Invention

This invention relates to improved cathodes for use with electrolytic cells used in the electrolysis of aqueous alkali metal halide solution for the production of halogen and caustic or alkali metal hypohalides.

2. Description of the Prior Art

The electrolysis of aqueous alkali metal halide solution such as solutions of sodium chloride or potassium chloride is conducted on a vast commercial scale. The electrolysis of alkali metal chlorides to produce elemental chlorine and alkali metal hydroxides is conducted in two general types of cells—the diaphragm and the mercury cathode cell. In the diaphragm cell, the cell is divided into two compartments—the anode compartment and the cathode compartment—which are separated by a porous or semiporous diaphragm which is usually made of asbestos or by an ion exchanger type membrane. The cathode is of perforated metal and the asbestos diaphragm is in contact with the cathode. The anode, which until recently was usually made of carbon or graphite, is disposed centrally in the anode compartment.

In the production of alkali metal hypochlorite and chlorate, anodes and cathodes (or bipolar electrodes which when arranged in a spaced electrical series in an electrolytic cell may serve as both anode and cathode) are submerged in an aqueous solution of the sodium chloride or the like and an electrical potential is established between the electrodes. In the past, graphite or carbon electrodes have been used as anodes or as the bipolar electrodes in series. In consequence of the electrochemical reactions which occur, alkali metal chlorate is produced either directly in the cell or outside the cell after the solution is allowed to stand.

In operating each of the above-described cells one was confronted with a common problem, namely, that during the course of the electrolysis, the carbon or graphite electrode gradually eroded or decomposed. Consequently, great interest was developed in a dimensionally stable anode that would be free of the objectionable characteristics of the graphite or carbon electrode. The dimensionally stable anodes which were developed are typically of titanium or similar valve metal and coated with a platinum metal or ruthenium oxide or alone or in combination with other oxide compounds. During the development of the improved anodes for the various electrolytic cells little or no attention has been given to the cathode employed in the cells which, as mentioned above, typically is a ferrous metal material.

Improvement in the cathode is desirable inasmuch as there is a voltage loss at the cathode in addition to a voltage loss at the anode of these electrolytic cells. Inasmuch as these cells consume tremendous amounts of electricity even a small amount, such as a tenth of a volt, of savings in electrical energy at either the cathode or the anode is of tremendous economic advantage and importance to the producer. Hindering the desire for better cathodes is the fact that the operating conditions of the cathode, e.g., high caustic concentration, heat, conductivity requirements and the like, are very deleterious to many materials which might otherwise be considered for such use.

SUMMARY OF THE INVENTION

In accordance with this invention there is provided in an electrolytic cell for the production of halogen and caustic or alkali metal hypohalides from aqueous alkali metal halide solutions wherein the cell is equipped with anodes and cathodes the improvement which comprises a composite cathode comprising a metal substrate having thereon a coating of rhenium.

DESCRIPTION OF THE PREFERRED EMBODIMENTS

In a diaphragm-type cell for the production of chlorine, the typical metal cathode has been of woven wire mesh construction. Ferrous metal cathodes of this type are well known and described in some detail in the textbook *Chlorine, Its Manufacture Properties and Uses*, J. S. Sconce, Editor, American Chemical Society Monograph No. 154, Reinhold Publishing Company, New York, New York, (1962) at page 90 et seq. which is incorporated herein by reference. Flat cathodes are also known, for instance see U.S. Pat. Nos. 1,464,689 and 3,335,079. Perforated and/or expanded metal sheet cathodes are also known. Any of the foregoing configurations of metal cathodes are suitable for the purpose of this invention. While commercially the metal of choice for cathodes has been a ferrous metal other metals, such as copper or nickel, can be used in this invention.

The rhenium is applied as a thin coating to the metal. The thickness of the coating can vary consistent with cell efficiency improvement sought, the economics of fabrication and the like. While theoretically a continuous monomolecular layer of rhenium will suffice, because of porosity a layer of from several microns up to about 0.001 inch in thickness is desirable and preferably the thickness is about 0.0001 to about 0.001 inches. The coating can be applied by electro-depositing on the base structure from a plating solution or chemideposited by forming a liquid film containing the rhenium on the ferrous metal and the drying of the film as is well known in the plating arts. Additionally, vacuum deposition, cladding, powder deposition, sintering, ionic plating sputtering, spraying, etc., techniques can be used to apply the rhenium coating. The coating can be applied to either one side only or both sides (or faces) of the cathode as desired depending on the configuration of the electrolytic cell wherein the cathode is to be employed.

The rusting and undercutting of ferrous metal substrates is a well known phenomenon. In an electrolytic cell the electrolyte containing $Cl^-$ and/or $OCl^-$ ions is very corrosive and ferrous metal starts corroding immediately. Thus, it is usually desirable to provide an intermediate coating between the rhenium and the cathode so as to avoid rusting and undercutting which might be occasioned by the porosity of the rhenium coating. A suitable intermediate coat is nickel or cobalt or a thin layer of each to make the intermediate coat which overcomes the undercutting and also provides a better bond with the rhenium. The intermediate coating can be deposited by various means. The coating can be deposited so as to increase the surface area, i.e., a rough, irregular but continuous deposit as opposed to the surface of a uniformly shaped or extruded wire and the like.

The cathodes of this invention provide for an electric current voltage savings in an electrolytic cell on the order of 0.2 to 0.3 volts at about 200 amps. per square foot (ASF).

The following examples are included to illustrate the preparation of the coated cathodes of this invention but are not to be considered limiting. Unless otherwise specified all temperatures are expressed in degrees centigrade and all parts are expressed as parts by weight.

At present, steel is used as the cathode material in the chlor-alkali and many other electrolytic cells. The cathodes are fabricated from a wire mesh or screen. In a Hooker cell the cathode screen wire is of approximately 0.078 inch diameter and the screen has 6 wires and 6 openings per inch. In order to examine the advantages offered by the coatings in comparison with the conventionally used steel, the test cathodes were made by depositing the coatings on the conventional material. Thus, the general geometry and structure of test cathodes were the same as those of the cathode material used in the Hooker's cell. The test and steel (control) cathodes were about 6.25 inches by 1.625 inches in size with a panhandle for electrical connection. The comparison between the test cathodes with experimental coatings and the conventional steel cathode was made by measuring the cathode potentials with respect to a calomel standard half cell and/or measuring the cell voltages. A twin cathode cell in which the test and the control cathodes were incorporated side-by-side in the same plane but separated from each other, a common asbestos diaphragm and a common dimensionally stable anode was used. The diaphragm and the anode were twice the size of the single cathode and disposed parallel to the cathode. The test and control cathodes were also incorporated in separate electrolytic cells for the measurements.

Saturated brine, purified and filtered to remove mainly calcium, magnesium, iron, and suspended matter was used as the electrolyte. The pH of the brine before entering the cell was between 9 and 11. The rate of flow of the catholyte flowing out of the cell and the salt cut was monitored from time to time to check that the cell was not running at extreme conditions. The advantages offered by the coatings in terms of cathodic potential or in terms of hydrogen overpotential were greater than the differences introduced by the usual variations in the flow and concentration in the catholyte. The temperataure of the cells was generally 120° to 140° F. but experiments were made in the lower and higher range.

The test cathodes were first coated with nickel (5 to 10 mil thick) and then with rhenium. The nickel plated cathodes were heated first in hydrogen and Argon to 500°–1000°C. for one to three hours to remove oxides and improve the adhesion of nickel to the steel as well as to the subsequent overcoating. (Other reducing gases in place of hydrogen and inert gases in place of Argon, e.g., helium or krypton, can be used.) The rhenium coatings were obtained by electroplating in a commercially available bath of rhenium-A manufactured by Technic Inc. (believed to be a rhenium/sulfamide type path) using the standard procedure, e.g., temperature 150° F., 150 ASF, 10 minutes per 0.0001 inch plate. The thickness of the outer coatings was about 0.0005 inches. It was found that if the rhenium was coated in two layers with a heat treatment process interposed in between them a more durable surface was obtained. After a partial, thin, initial coat of rhenium is applied, the cathode was heated to about 500° to 1000°

C. in a reducing gas (e.g., hydrogen) and finally cooled in an inert gas (Argon) for one-half to three hours. Thereafter, a second coat of rhenium was applied to obtain the desired thickness and obtain a surface more durable against physical damage, e.g., dislodging the coatings in storage, or during or after electrolysis.

Cathodes of other shapes, sizes and geometry can be used as long as they have the rhenium coating.

Summarized in tabular form below is the test data for a diaphragm-type chlorine cell showing amount of reduction in voltage requirements at various amps. per square foot (hereinafter referred to as ASF) for the cell equipped with the rhenium coated cathode compared to the other cell equipped with a conventional uncoated cathode. In each case the coated cathode had a nickel intermediate coating and then heat treated before the rhenium was applied. The diaphragm was deposited asbestos.

| Example | Days of Cell Operation | Voltage Reduction at Stated ASF 19 | 38 | 95 | 133 | 190 | 228 | 298 |
|---|---|---|---|---|---|---|---|---|
| 1 | 1 | 0.09 | 0.13 | 0.20 | 0.21 | 0.21 | 0.22 | 0.23 |
| 2 | 2 | 0.10 | 0.14 | 0.21 | 0.22 | 0.24 | 0.24 | 0.26 |
| 3 | 5 | 0.10 | 0.14 | 0.20 | 0.21 | 0.22 | 0.23 | 0.24 |
| 4 | 6 | 0.09 | 0.13 | 0.20 | 0.21 | 0.22 | 0.23 | 0.22 |
| 5 | 7 | 0.09 | 0.13 | 0.19 | 0.20 | 0.22 | 0.22 | 0.23 |

From the foregoing table it will be seen that consistent results are obtained depending only on the ASF level. Since commercial cell ASF levels are 100 or more, significant savings in electrical energy is obtained by the use of this invention.

The rhenium coated cathodes can be used in alkali cells in general rather than just those used in producing caustic and chlorine since the rhenium coating was also found to be stable against chemical corrosion (e.g., $OCl^-$ or $ClO_3^-$ ion attack) and therefore suitable for use in hypochlorite and chlorate cells which generally are similar to chlorine cells except for the absence of the diaphragm.

The foregoing examples and methods have been described in the foregoing specification for the purpose of illustration and not limitation. Many other modifications and ramifications will naturally suggest themselves to those skilled in the art based on this disclosure. These are intended to be comprehended as within the scope of this invention.

The embodiments of the invention in which an exclusive property or privilege is claimed are defined as follows:

1. In an electrolytic cell for the production of halogen and caustic or alkali metal hypohalides and chlorates from alkali metal halide solutions wherein the cell is equipped with anodes and cathodes, the improvement which comprises a composite cathode comprising a metal substrate having thereon a coating of rhenium.

2. The electrolytic cell of claim 1 wherein the coating is on one side of the cathode.

3. The electrolytic cell of claim 1 wherein the coating is on both sides of the cathode.

4. The electrolytic cell of claim 1 wherein there is a layer of nickel or cobalt intermediate said metal substrate and the rhenium coating.

5. The electrolytic cell of claim 4 wherein the intermediate layer has a nonuniform thickness so as to increase the surface area.

6. The electrolytic cell of claim 4 wherein the rhenium coating is applied as two separate layers.

7. The electrolytic cell of claim 5 wherein the coating is rendered more durable by heat treating in a reducing gas after the application of the intermediate layer and again after the first layer of rhenium.

8. The electrolytic cell of claim 1 wherein the cathode is separated from the anode by a diaphragm.

9. The electrolytic cell of claim 1 wherein the cathode is separated from the anode by a membrane.

* * * * *